US005522207A

United States Patent [19]

Keip

[11] Patent Number: 5,522,207

[45] Date of Patent: Jun. 4, 1996

[54] AIR ASSISTED FEED THROUGH CONVEYOR FOR ROTARY FILM WRAPPING APPARATUS

[75] Inventor: Charles Keip, Grandville, Mich.

[73] Assignee: Liberty Industries, Girard, Ohio

[21] Appl. No.: 337,034

[22] Filed: Nov. 10, 1994

Related U.S. Application Data

[63] Continuation of Ser. No. 38,232, Mar. 29, 1993.

[51] Int. Cl.[6] ..... B65B 65/00; B65B 11/00; B65B 49/00; B65B 41/00

[52] U.S. Cl. ..... 53/556; 53/389.2; 53/210

[58] Field of Search ..... 53/210, 255, 258, 53/259, 389.2, 389.3, 556, 588; 384/100; 226/196

[56] References Cited

U.S. PATENT DOCUMENTS

| | | | |
|---|---|---|---|
| 3,744,693 | 7/1973 | Greiner | 226/196 |
| 4,050,220 | 9/1977 | Lancaster et al. . | |
| 4,236,851 | 11/1980 | Szasz . | |
| 4,317,322 | 3/1982 | Lancaster et al. . | |
| 4,711,069 | 12/1987 | Silbernagel . | |
| 4,925,080 | 5/1990 | Crouse et al. | 226/196 |
| 4,979,358 | 12/1990 | Keip . | |
| 5,182,894 | 2/1993 | Bate | 53/588 |

FOREIGN PATENT DOCUMENTS

| | | | |
|---|---|---|---|
| 3431628 | 3/1986 | Germany . | |
| 1588412 | 4/1981 | United Kingdom | 53/210 |

*Primary Examiner*—John Sipos
*Assistant Examiner*—Rodney A. Butler
*Attorney, Agent, or Firm*—Harpman & Harpman

[57] ABSTRACT

An improvement in a bridge conveyor for a rotary stretch film wrapping apparatus for wrapping a product in a plastic film. The products are conveyed to a transition bridge around which the elongated shrink film is wrapped. The improved bridge conveyor system includes a pair of horizontally spaced air assisted guides adjacent an endless conveyor. The air assisted guides provide an air cushion on which the plastic film rides.

4 Claims, 3 Drawing Sheets

AIR ASSISTED FEED THROUGH CONVEYOR FOR ROTARY FILM WRAPPING APPARATUS

This is a continuation of U.S. patent application Ser. No. 08/038,232, filed Mar. 29, 1993.

BACKGROUND OF THE INVENTION

1. Technical Field

The present invention relates to a bridge conveyor system used in rotary stretch wrapping apparatus that require film engagement guide means to allow the film to travel along in the same direction as the product during wrapping.

2. Description of Prior Art

Prior art devices of this type have relied on a wide variety of conveyor and guide configurations. Such systems typically use multiple endless belts positioned in stacked relation one above another or single belt systems using side mounted low friction guides. Other air assisted configurations use multiple aperture conveyor surfaces to "float" articles there across. For example, of the hereinbefore described systems, see U.S. Pat. Nos. 4,317,322, 4,979,358, 4,236,851, 4,050,220, 4,711,069 and German Patent DE3431628.

In U.S. Pat. No. 4,317,322 a twin belt conveyor is described that uses the top conveyor belt to hold and transport the product while the second conveyor belt positioned below the first travels in the opposite direction so that the film will engage and travel in the same direction as the product during wrapping.

Applicant's own U.S. Pat. No. 4,979,358 discloses a conveyor system that uses a pair of side by side endless conveyors that use a plurality of expandable supports that travel in one direction supporting the product and engage the film in the return travel direction.

In U.S. Pat. No. 4,236,851 a disk handling system is shown that uses an apertured conveyor surface through which air, under pressure, is supplied "floating" the products thereacross.

U.S. Pat. No. 4,050,220 a simple bundling machine is claimed wherein a conveyor system using conveyor belts mounted on rolls with wrapping guide rails to support the load while it is being wrapped. The rails can also be of a porous or hollow material so air under pressure passes therethrough engaging the film. No claim or drawing is shown illustrating the alleged form of the invention briefly referred to.

In U.S. Pat. No. 4,711,069 a stretch foil wrapping arrangement is disclosed wherein a transition bridge is claimed having upper and lower conveyors including an internal roller plane having an inner portion or an external roller plane having an inner portion or an inner roller plane of the remaining transition conveyor.

In German Patent DE3431628 a device is shown that is directed towards a bridging conveyor for wrapping packages or bundles in stretch foil apparatus wherein a pair of vertical spaced conveyors are used to engage the packages to be wrapped. Foil guides are disclosed on each of the conveyors defined as curved hollow elements that are apertured along their outer curved surface. Compressed air is supplied to the hollow elements defining an air cushion over the guide. The foil defines a sealing area of the guide adjacent its top portion and lower portion in order to trap the air between the two surfaces to form a cushion as required.

The hereinbefore described air cushion systems are not practical in that the apertured hollow supply guides cannot supply air distribution evenly over the guide surface given the economic restrictions of supplying huge quantities of air under high pressure. The key to successful i.e. economical feasibility air cushions is to coat the surface of the support guides with a thin even film of air on which the stretch film under high engagement forces will travel. Applicant's solution to this problem requires precise distribution of the air supply to a high density yet porous material.

SUMMARY OF THE INVENTION

The present invention is directed towards an improvement in a bridge conveyor for rotary stretch film wrapping apparatus in which air assisted guides completely support the stretch film on a coating of air film created by direct permutation of a porous material by air under high pressure. The air assisted guided provide a unique air supply dispersion to the permeable surface which is critical to the efficiency of air utilization that makes operating such an air assisted guides possible and practical.

DESCRIPTION OF THE PREFERRED EMBODIMENT

Figure 1:
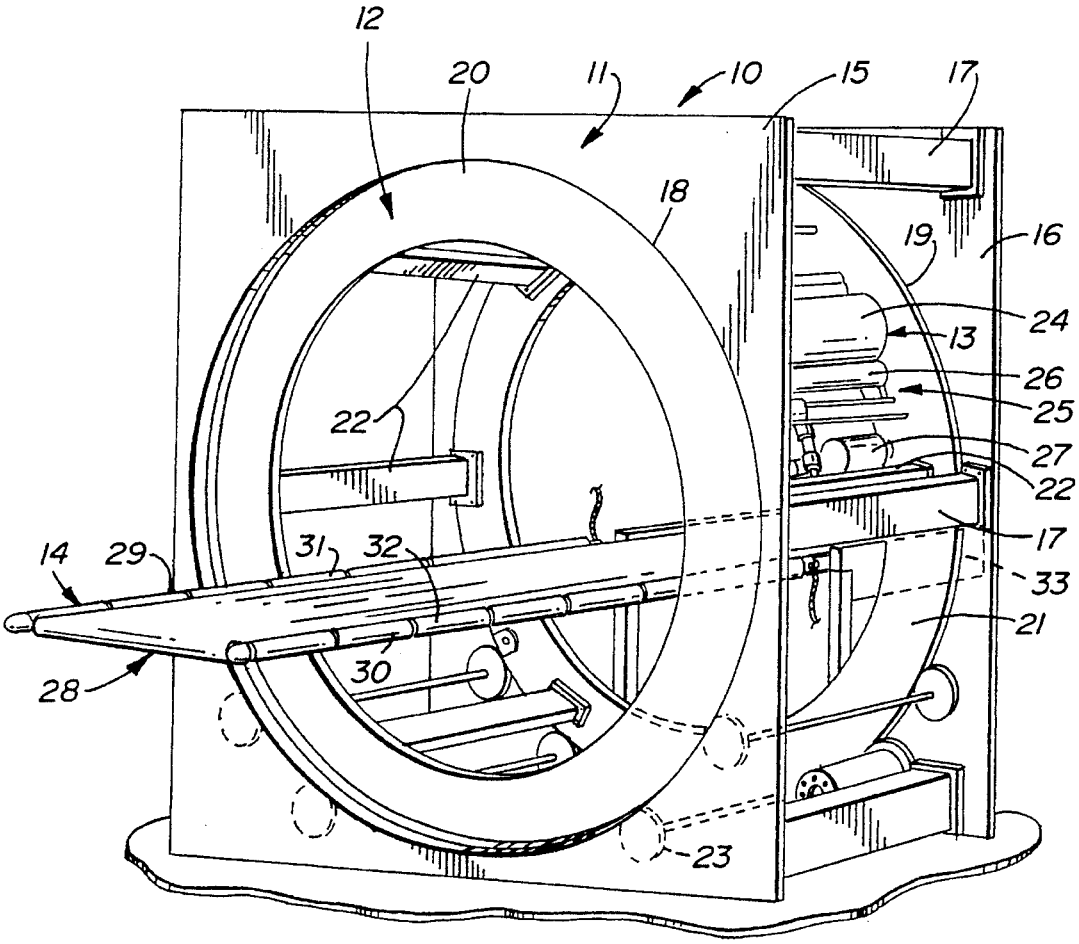
FIG. 1 is a perspective view of a stretch film wrapping apparatus with portions deleted showing the air assisted feed through conveyor of the invention.

Referring now to FIG. 1 of the drawings a rotary stretch wrapping apparatus 10 can be seen having a fixed base frame 11, a rotary cage 12, a wrapping assembly 13 and an air assisted bridge conveyor system 14 extending outwardly therefrom. This conveyor system cooperates with other conveyors to affect the wrapping of the products with protective plastic film in the rotary stretch wrapping apparatus 10 which is generally well known to those skilled in the art.

The base frame includes a pair of spaced upstanding sheets 15 and 16 with a number of interconnecting beams 17. Each of the sheets 15 and 16 defines a large central opening 18 and 19 through which the products to be wrapped are passed.

The rotary cage 12 is mounted to the base frame 11 and is comprised of a pair of annular rings 20 and 21 and a plurality of interconnecting brace members 22. The cage 12 is mounted for rotation about a substantially horizontal axis by a plurality of rollers 23, shown in broken lines, journaled between the respective sheets 15 and 16. The film wrapping assembly 13 is secured to the cage 12 and is adapted to releaseably mount a roll of plastic film 24 for rotation about a substantially horizontal axis. A roll driving assembly 25 includes a driving roller 26 adapted to engage the outer periphery of the roll of film 24 at all times during the wrapping operation. The driving roller 26 is preferably driven by an electric DC motor 27 as is well known and understood by those skilled in the art.

In operation, the product P to be wrapped is passed through the cage 12 on the improved air assisted conveyor system 14 seen in FIGS. 1–6 of the drawings.

Figure 3:
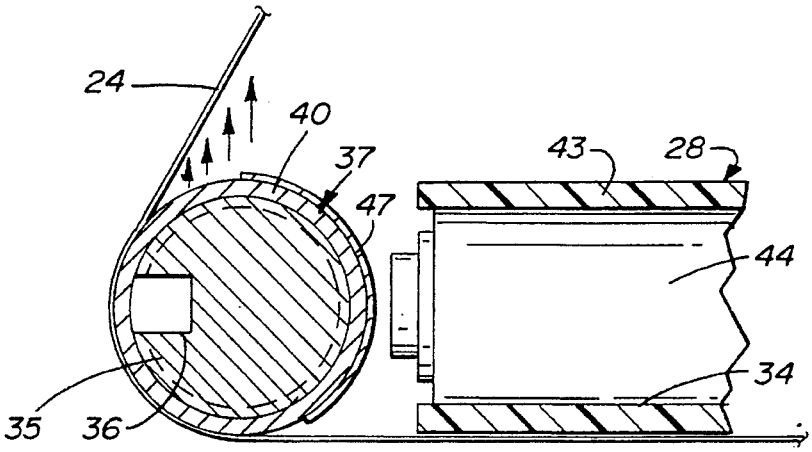
FIG. 3 an enlarged partial cross-sectional view of the invention on lines 3—3 of FIG. 2.
Figure 2:
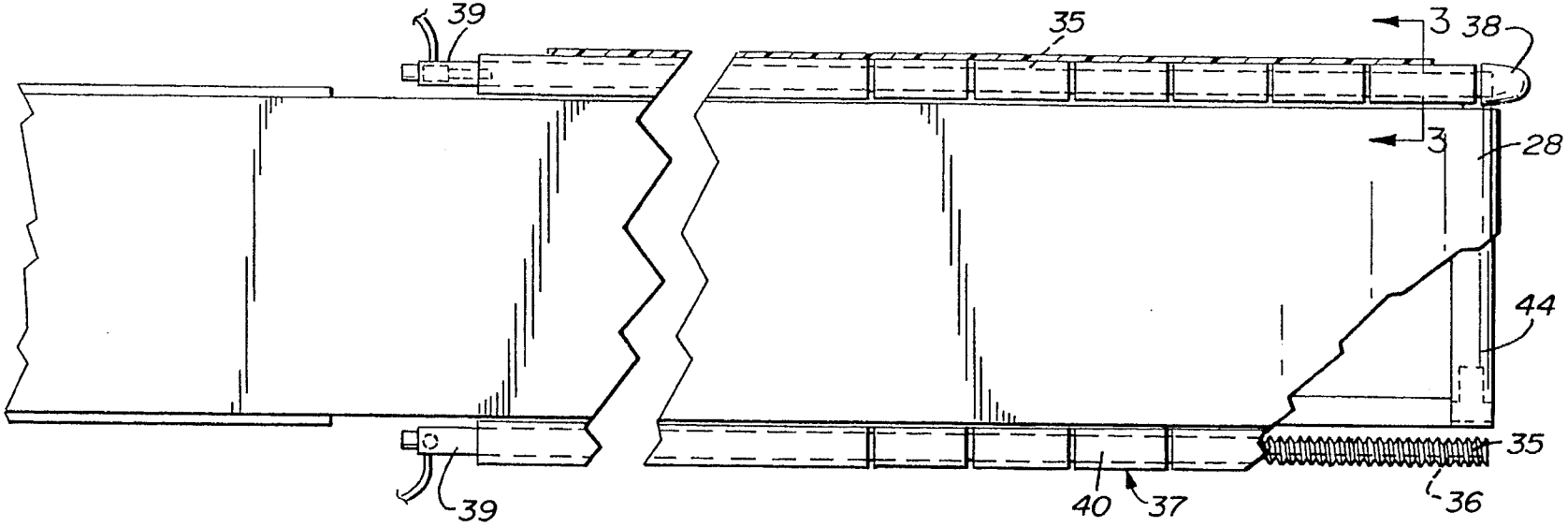
FIG. 2 is a front top plan view of the invention with portions broken away.
Figure 4:
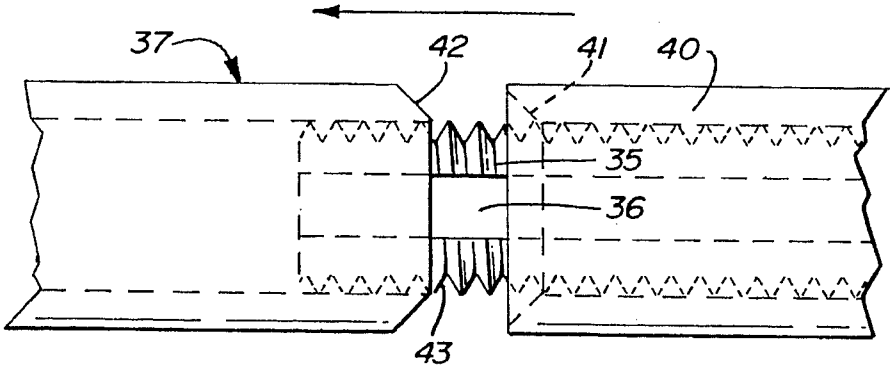
FIG. 4 is an enlarged side plan view of a portion of the invention in a modified exploded position.
Figure 6:
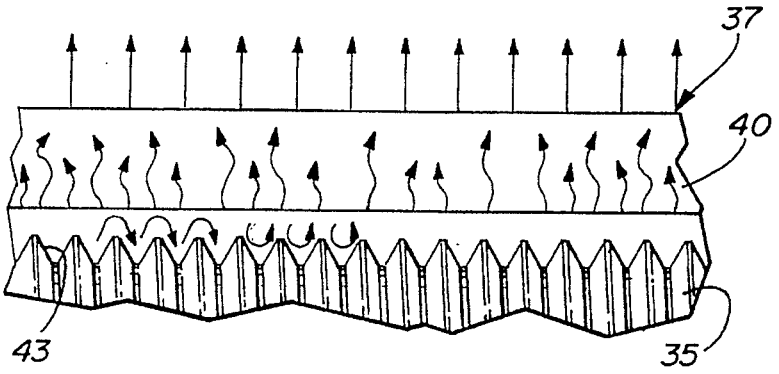
FIG. 6 is an enlarged fragmentary cross-sectional view of a portion of the air assisted guides during operation showing the porosity of the surface and air distribution thereto.

The air assisted conveyor system 14 generally comprises a single horizontally positioned endless conveyor belt assembly 28 having an infeed portion and an outfeed portion pair of horizontally opposing air guides 29 and 30 each adjacent longitudinal edges 31 and 32 of said conveyor, see FIGS. 1—3 of the drawings. The conveyor and air guides are mounted on a support stand 33 in a cantilevered manner such that the free end of said conveyor 28 extends well within and substantially through the cage 12. The two air guides 29 and 30 are substantially arranged in a horizontal plane such that portions of said guide extend below and in spaced relation laterally outwardly from said bridge conveyor so that they will engage the film 24 and space same in relation to a return belt path at 34 of said conveyor assembly 28. Each of the air guides 29 and 30 includes an elongated central threaded rod 35 extending the length thereof. The threaded rod 35 is notched along its length at 36 to provide an air supply conduit. Multiple air permeable segmented cylindrical sleeves 37 are positioned over said threaded rod 35 in abutting end to end relationship terminating at an end cap 38 and an air supply fitting 39 respectively. The segmented cylindrical sleeves 37 in this example are of a sintered bronze a material well known for its fluid permeability under pressure. Sleeve segments 40 have respective registering end configurations 41 and 42 that dove tail or nest together as illustrated in FIG. 4 of the drawings to form the segmented cylindrical sleeve 37. The relative fit or tolerance between the threaded rod 35 and the interior of the cylindrical sleeve 37 is such that air under pressure will pass around the threaded rod 35 and between concentric thread flights 43 as seen in FIG. 6 of the drawings. Thus the thread flights 43 create an efficient air supply distribution which is key to the even air penetration of the cylindrical sleeve 37. The notch at 36 is a central air supply conduit for the threaded configuration hereinbefore described which is in turn supplied by a source of air pressure, not shown, via said air supply fitting 39.

Figure 5:
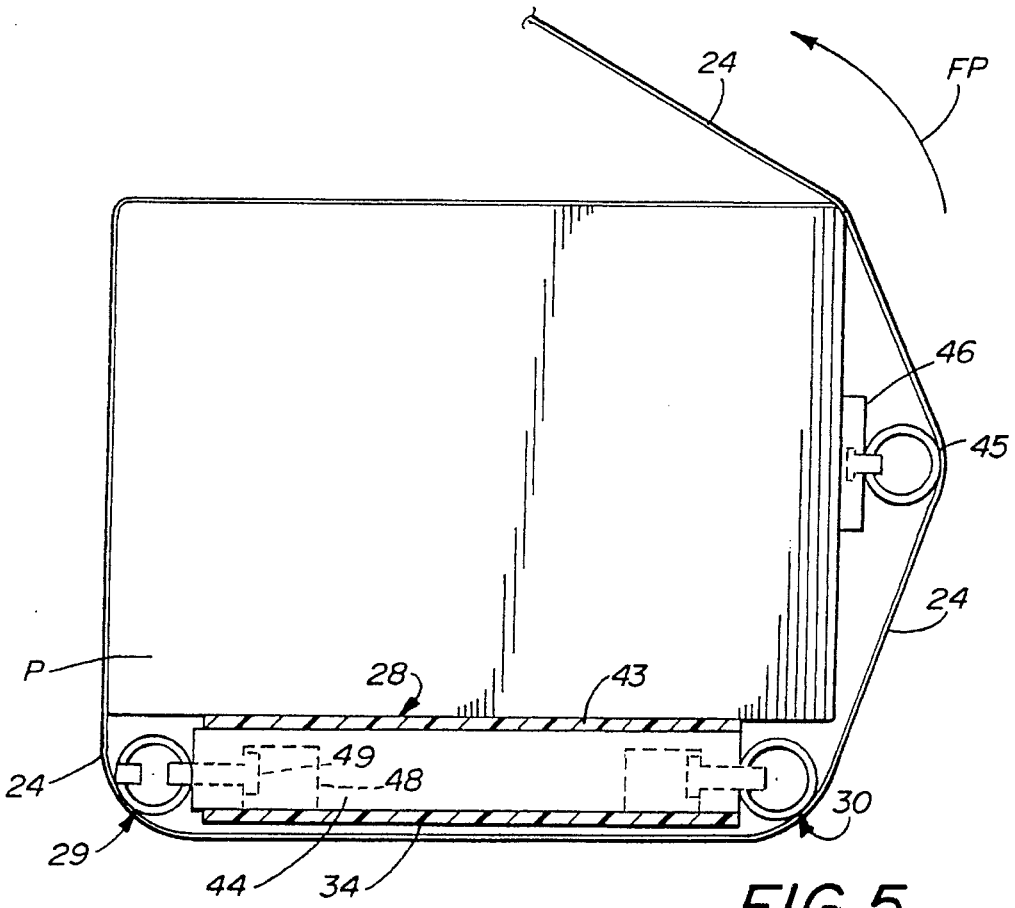
FIG. 5 is a partial cross-sectional view of the air assisted conveyor with a package wrapped in stretch film illustrating the film path about the package and engagement points with the air assisted conveyor guides.

Referring now to FIGS. 2 and 5 of the drawings, the endless conveyor belt assembly 28 comprising a belt 43, support and belt drive rollers 44 as is well known in the art.

In use, as seen in FIG. 5 of the drawings, the film 24 has been wrapped around the product (P) on the conveyor belt assembly 28 with the film engaging the respective air guides 29 and 30 and an alternate auxiliary air guide 45 on a support bracket 46 which engages said side of said product P to offset the directional wrapping forces imparted by the rotation of the film dispensing assembly 13 with the cage 12 indicated by the described arrows FP (film path).

Referring to FIG. 3 of the drawings, the film 24 is shown engaging the air guide 29 wherein the film 24 actually rides on a coating of air, promulgated by the porous sintered cylinder segments 40. Also shown is an optional air deflector 47 that can be adhesively secured to the non-film engagement portion of the porous cylinder segments 40 in situations of low or diminished air supply available to maintain the desired flow rate to support the film 24 while under wrapping pressure.

An air guide mounting assembly 48 is shown in dotted lines in FIG. 5 of the drawings extending from said conveyor assembly 28, and has multiple mounting brackets 49 to hold and position said respective air guides 29 and 30 in relation to said conveyor assembly 28.

The above description is that of the preferred embodiment and various changes and modifications may be made therein without departing from the spirit of the invention.

I claim:

1. A stretch wrapping machine comprising a bridge conveyor having an infeed portion, an outfeed portion to convey articles, a wrapping device to dispense wrapping film in a wrapping area onto articles moving between said infeed portion and said outfeed portion of said bridge conveyor; and a pair of air bearings generally parallel to said bridge conveyor to support the wrapping film in the wrapping area, said air bearings positioned to prevent contact between the wrapped film and the bridge conveyor, each of said air bearings including a support rod within a fluid permeable cylindrical sleeve member positioned in spaced relation to said support rod wherein said sleeve member having apertures not pre-determinedly formed defining a fluid delivery passageway, each of said sleeve members having an outer surface, whereby fluid delivery to said passageway under pressure defines an annular air conduit within said passageway about said support rod traveling through said fluid permeable member to provide a fluid bearing on said outer surface of said member.

2. A stretch wrapping machine as defined in claim 1 wherein said fluid is a gas.

3. A stretch wrapping machine as defined in claim 1 wherein said outer surface of each of said air bearings include a first portion located below said bridge conveyor and a second portion located laterally outwardly of said bridge conveyor.

4. A stretch wrapping machine as defined in claim 2 wherein the gas is air.

* * * * *